US005300405A

United States Patent [19]

Yamada et al.

[11] Patent Number: 5,300,405

[45] Date of Patent: Apr. 5, 1994

[54] PROCESSING OF PHOTOGRAPHIC SILVER HALIDE PHOTOSENSITIVE MATERIAL AND PROCESSOR USED THEREIN

[75] Inventors: Minoru Yamada; Junichi Kose; Shinichi Matsuda; Yasuhiro Kawai, all of Kanagawa, Japan

[73] Assignee: Fuji Photo Film Co., Ltd., Kanagawa, Japan

[21] Appl. No.: 35,399

[22] Filed: Mar. 23, 1993

[30] Foreign Application Priority Data

Mar. 23, 1992 [JP] Japan ..... 4-095813

[51] Int. Cl.[5] ..... G03C 5/26

[52] U.S. Cl. ..... 430/363; 430/453; 430/963

[58] Field of Search ..... 430/363, 453, 455, 963; 354/302, 305, 329, 331, 340

[56] References Cited

U.S. PATENT DOCUMENTS 5,001,046 3/1991 Honda et al. ..... 430/963

FOREIGN PATENT DOCUMENTS 430212 6/1991 European Pat. Off. .
1-123236 5/1989 Japan .
1-234849 9/1989 Japan .
2163370 2/1986 United Kingdom ..... 354/331

*Primary Examiner*—Hoa Van Le
*Attorney, Agent, or Firm*—Sughrue, Mion, Zinn, Macpeak & Seas

[57] ABSTRACT

Sheets of photosensitive material are processed through a processor comprising a series of developing, fixing, washing and drying sections, the drying section 14 including a plurality of conveyor rollers 42, a drive shaft operatively coupled to the rollers, and a plurality of nozzles 50 for injecting hot air against the traveling sheets. The rollers 42 and/or the nozzles 50 are arranged in the drying section so as to satisfy at least one of the relationships (1) and (2):

$$k_1M+0.5<L<(k_1+1)M-0.5 \quad (1)$$

$$k_2M+0.5<P<(k_2+1)M-0.5 \quad (2)$$

wherein L is the distance (in mm) between two adjacent conveyor rollers in the drying section, P is the distance (in mm) between two adjacent nozzles, M is the distance (in mm) over which the sheet is fed per revolution of the drive shaft, $k_1$ is equal to 0 or an integer of 1 to 8, and $k_2$ is equal to 0 or an integer of 1 to 8. Drying marks are eliminated in rapid processing using a fixer with reduced hardening effect and the drying section having an increased drying capacity.

11 Claims, 7 Drawing Sheets

$L = k_1 \cdot M$ $L \neq k_1 \cdot M$

PROCESSING OF PHOTOGRAPHIC SILVER HALIDE PHOTOSENSITIVE MATERIAL AND PROCESSOR USED THEREIN

BACKGROUND OF THE INVENTION

1. Field of the Invention

This invention relates to a method for processing a photographic silver halide photosensitive material which is simply referred to as photosensitive material hereinafter, and an automatic processor used therein.

2. Prior Art

Currently, most photographic silver halide photosensitive materials are processed using automatic developing machines or processors. Although a variety of processors are available, the processor to which the present invention pertains has a series of development, fixation, washing and drying functions.

The recent trend in the art is toward rapid processing of photosensitive material. For graphic art photosensitive materials, X-ray photosensitive materials, scanner photosensitive materials, and CRT image recording photosensitive materials, for example, there is an increasing need for rapid processing.

From the standpoint of environment protection, it is desired to reduce the amounts of processing solutions (including developer and fixer solutions) used in the processing of photosensitive material for reducing waste liquid disposal loads. The amounts of replenisher solutions to be replenished with the progress of photosensitive material processing must be reduced before the amount of waste liquid can be reduced. However, as processing becomes rapid and as the volume of fixer replenished is reduced, the fixation step becomes lower in fixing ability, resulting in insufficient desilvering of silver halide in unexposed areas and retention of more thiosulfate from the fixer solution in the photosensitive material which thus loses image stability on storage. Additionally, the sensitizing dye is not fully dissolved out of the photosensitive material, leaving unnecessary color (or residual color) in the processed photosensitive material.

In processing X-ray sensitive material, a developer containing an aldehyde hardener is often used in combination with a fixer containing an aluminum salt hardener as described in Japanese Patent Application Kokai (JP-A) No. 158439/1989. Since the aluminum salt hardener is more effective for hardening with lower pH levels, the working fixer solution is conventionally maintained at pH 4.0–4.5 by adjusting the pH of fixer solution and replenisher and by controlling the replenishment rate. The fixer at such low pH, however, can give off sulfur dioxide gas and acetic acid gas, producing unpleasant odor and causing corrosion of the processor and surrounding equipment. This is not desirable for the working environment since current processors are often installed in ordinary rooms rather than in special rooms.

Under the circumstance, the applicant proposed in JP-A 168741/1991 to process with a fixer which would provide a running equilibrium solution at pH 4.6 or higher. Although this method improves or eliminates the odor problem, the fixer is low in hardening effect, which leads to increased drying loads, often resulting in uneven drying or drying marks.

In view of the preparation (formulation) of developer and fixer concentrates as well as the preparation (dilution) of concentrates into working solutions, the processing solutions of one part composition are more advantageous than those of two or more part composition. Since the one part composition requires only dilution to form a working solution, the processor can be equipped with an automatic solution preparation system (for example, FCR-7000 system CR-LP-414, manufactured by Fuji Photo-Film Co., Ltd.).

In order that the developer concentrate be of one part composition, dialdehyde hardeners should be avoided since they are less stable in alkaline solution. In order that the fixer concentrate be of one part composition, it should be at pH 4.6 or higher for maintaining thiosulfates stable. Then the processing solutions provide little or no contribution to hardening and accordingly, photosensitive material should originally be increased in film strength. Increasing the film strength of photosensitive material is favorable for drying, but not for rapid processing because development, fixation and washing are all retarded. This means that the film strength of photosensitive material is limited and then, the above-mentioned feature of the processing system is retained, but drying loads are increased, often resulting in drying defects.

As previously mentioned, it is desired to reduce the replenishment volume. As the replenishment volume of fixer is reduced, the proportion of developer carried into the fixing bath from the developing bath is increased. The working fixer solution is thus increased in pH and the above-mentioned processing system must accommodate for increased drying loads.

Moreover, a demand for more rapid processing of photosensitive material requires that the overall processing time or dry-to-dry processing time be reduced from conventional 90 seconds to about 60 or 45 seconds. Then the drying time must be reduced while the drying capacity must be increased.

With the foregoing facts taken into account, it is generally desired to increase the drying capacity. One approach is to extend the drying zone, but not recommended because both the size and cost of the processor are increased. Other approaches for increasing the drying capacity are to increase the heater capacity and the air flow rate in the drying section, both of which can be implemented to some extent although a certain energy limit exists. It is also possible to use far-infrared heaters as disclosed in JP-A 234849/1989 and 118840/1989. Blower means for injecting hot air against photosensitive material surface is disclosed in JP-A 123236/1989 and 265855/1991. The drying capacity can be maximized by properly selecting the configuration of the blower means and the spacing thereof to the photosensitive material.

All these approaches are successful in increasing the drying capacity to some extent and leave little or no drying marks in the conventional 90-second process. However, in more rapid 60 or 45-second processes, drying marks can be left. Because of the increased drying capacity, such drying marks occur in certain intervals or cycles and varying degrees of drying appear as variations in image reflection density.

SUMMARY OF THE INVENTION

Therefore, a primary object of the present invention is to provide a method for processing photographic silver halide photosensitive material which allows for the use of a higher pH fixer for facilitating the solution preparation and improving the working environment and insures rapid processing accompanied by drying with an increased drying capacity while eliminating drying marks.

Another object of the present invention is to provide an automatic procesor having improved drying performance.

The present invention provides a method for processing a photographic silver halide photosensitive material after exposure through an automatic processor. The processor includes a developing section for developing the material with an alkaline developer, a fixing section for fixing the material with a fixer at pH 4.6 or higher, a washing section for washing the material with water or a stabilizing section for stabilizing the material, and a drying section for drying the material. The processor drying section includes a plurality of conveyor rollers for defining a path, a drive shaft operatively coupled to the rollers to rotate the rollers for feeding the photosensitive material forward along the path, and a plurality of air injectors for injecting hot air against the surfaces of the photosensitive material traveling along the path. The plurality of conveyor rollers are arranged in the drying section so as to satisfy the relationship represented by the following formula (1):

$$k_1M+0.5<L<(k_1+1)M-0.5 \quad (1)$$

wherein L is the distance (in mm) between two adjacent conveyor rollers, M is the distance (in mm) over which the photosensitive material is fed per revolution of the drive shaft, $k_1$ is equal to 0 or an integer of 1 to 8. Alternatively or additionally, the plurality of air injectors are arranged in the drying section so as to satisfy the relationship represented by the following formula (2):

$$k_2M+0.5<P<(k_2+1)M-0.5 \quad (2)$$

wherein P is the distance (in mm) between two adjacent air injectors, M is as defined above, and $k_2$ is equal to 0 or an integer of 1 to 8.

In one preferred embodiment, the drying section further includes a gear having a plurality of teeth coupled between the drive shaft and the conveyor rollers, and the plurality of conveyor rollers are arranged in the drying section so as to satisfy the relationship represented by the following formula (3):

$$k_3N+0.5<L<(k_3+1)N-0.5 \quad (3)$$

wherein L is as defined above, N is the distance (in mm) over which the photosensitive material is moved per movement of the gear by one tooth, and $k_3$ is an integer of 1 to 20.

Preferably, the air injectors inject hot air against the photosensitive material surfaces in a direction opposite to the feed direction of the photosensitive material. Each air injector includes a nozzle orifice which is spaced a distance of 1 to 15 mm apart from the path. For enhancing drying, the drying section may further include a far-infrared heater or at least one of the conveyor rollers in the drying section may be a heat roller.

The method is generally adapted for rapid processing and the overall processing time is about 20 seconds to about 90 seconds.

In one preferred embodiment, the fixer is a one-part type fixer solution available in concentrate or working solution form. The fixer may or may not contain an aluminum salt hardener. The photosensitive material has a swelling factor of up to 250% when the fixer contains an aluminum salt hardener and a swelling factor of up to 200% when aluminum salt free. The fixer is replenished at a rate of 0.05 to 0.6 liters per square meter of the photosensitive material.

An automatic processor of the above-mentioned arrangement is also contemplated herein.

While meeting a demand for rapid processing, the invention intends to simplify solution preparation and improve the working environment by increasing the pH of the fixer. Then the fixer has weaker hardening effect. This type of processing is accompanied by an increase in drying load. The invention thus employs a hot air drying system wherein air injectors inject hot air against the surfaces of photosensitive material which is fed forward by means of conveyor rollers as disclosed in JP-A 123236/1989 and 265855/1991. This system provides an increased drying capacity.

However, this drying system has the problem that since a drive shaft for transmitting the driving force to the conveyor rollers does not make a fully uniform revolution, drying marks appear at intervals on the photosensitive material in accordance with driving variations during one revolution of the conveyor rollers. The present invention prevents occurrence of such drying marks by setting the roller-to-roller distance L in accordance with formula (1), which implies that L is not an integral multiple of the distance M over which the photosensitive material is fed forward per revolution of the roller.

Also because the drive shaft for transmitting the driving force to the conveyor rollers experiences variations in its revolution, injection of hot air from the air injectors or nozzles is not uniform at the surface of photosensitive material, which leaves periodic drying marks on the photosensitive material. The present invention prevents occurrence of such drying marks by setting the nozzle-to-nozzle distance P in accordance with formula (2), which implies that P is not an integral multiple of the distance M over which the photosensitive material is fed forward per revolution of the roller.

Moreover, variations in rotational speed in the meshing gears for transmitting the driving force to the drive shaft of the rollers in the drying section also cause occurrence of periodic drying marks on the photosensitive material. The present invention prevents occurrence of such drying marks by setting the roller-to-roller distance L in accordance with formula (3), which implies that L is not an integral multiple of the distance N over which the photosensitive material is fed forward per rotation of the gear by one tooth.

The invention requires that at least one of relationships (1) and (2) is satisfied, preferably both of relationships (1) and (2) are satisfied, and more preferably relationship (3) is additionally satisfied, thereby eliminating drying marks.

BRIEF DESCRIPTION OF THE DRAWINGS

While the specification concludes with claims particularly pointing out and distinctly claiming the present invention, it is believed that the same will be better understood from the following description taken in conjunction with the accompanying drawing in which:

DETAILED DESCRIPTION OF THE PRESENT INVENTION

Figure 1:
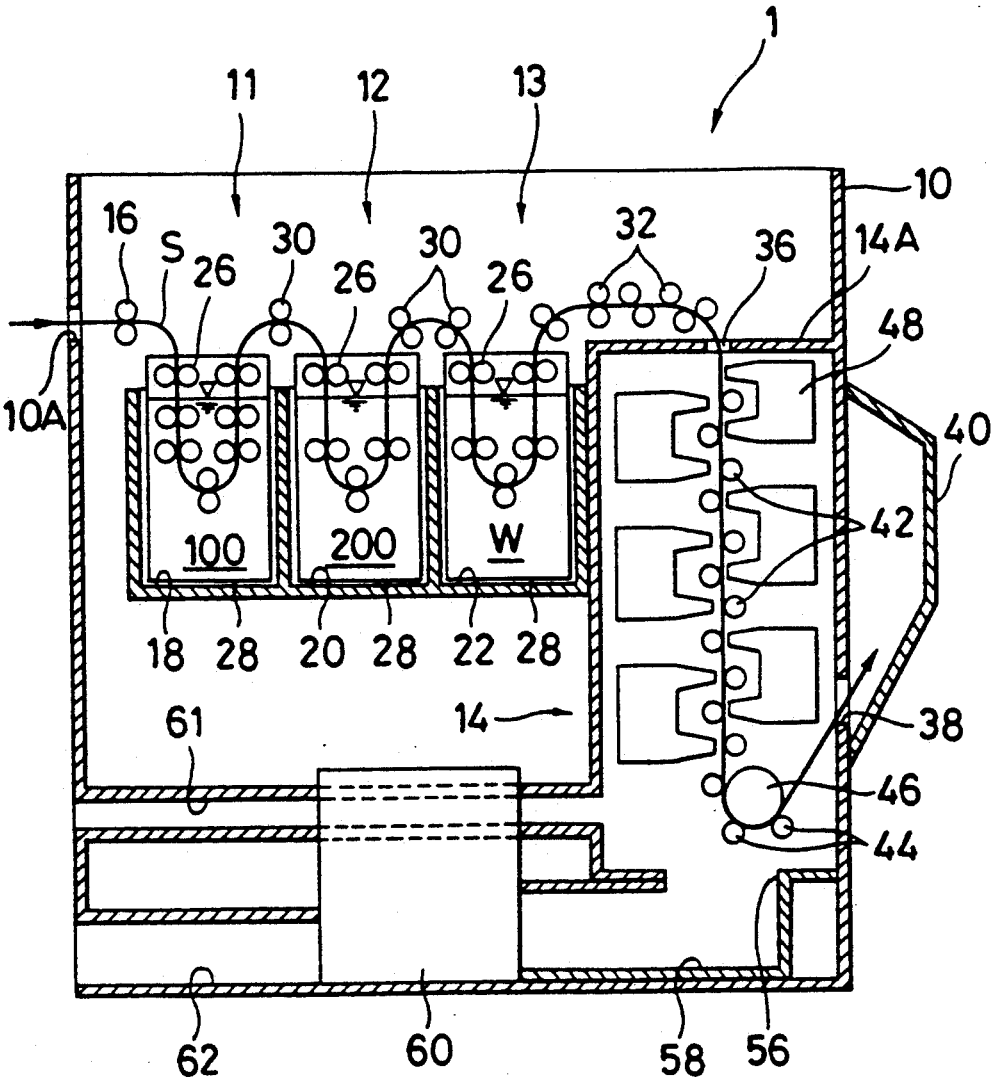
FIG. 1 schematically illustrates one exemplary automatic processor arrangement according to the present invention.

Referring to FIG. 1, there is schematically illustrated one exemplary arrangement of the automatic processor used in the present invention. The processor generally designated at 1 is adapted to subject a length of photosensitive material S to a series of steps: development→fixation→washington→drying and accordingly includes a developing section 11, a fixing section 12, a washing section 13 and a drying section 14 disposed in serial arrangement in a housing 10. A length of photosensitive material encompasses both a continuous length and discrete sheets of photosensitive material while discrete sheets are used in the following embodiment for brevity of description.

The developing section 11 includes a developing tank 18 filled with a developer solution 100, the fixing section 12 includes a fixing tank 20 filled with a fixer solution 200, and the washing section 13 includes a washing tank 22 filled with washing water W.

The sheet of photosensitive material S is carried into the interior of the processor casing 10 through an inlet 10A and inlet rollers 16, passed through the developing, fixing and washing tanks 18, 20 and 22 along a serpentine path and then guided into the drying section 14. Each of the developing, fixing and washing tanks 18, 20 and 22 has received therein a rack 28 including a plurality of guide or feed rollers 26 mounted in a frame. The guide rollers 26 are disposed so as to feed the sheet S along a U-shaped path in each tank, that is, to move the sheet S downwardly from the tank solution surface to near the tank bottom, reverse the moving direction at the bottom and then feed the sheet S upwardly to the tank solution surface again.

Crossover rollers 30 are disposed between the developing and fixing tanks 18 and 20 and between the fixing and washing tanks 20 and 22, respectively, so that the sheet S is sequentially guided to the following tank, from the developing tank to the fixing tank and then to the washing tank. Then the sheet sequentially undergoes development, fixation and washing. Also plural pairs of rollers 32 are disposed between the washing tank 22 and the drying section 14 for guiding the washed sheet S to the drying section 14 through an inlet port 36 in a housing 14A defining the drying chamber. Since the sheet S emerging from the washing tank 22 carries water thereon, the paired rollers 32 also serve to squeeze off some water from the sheet S.

In the interior of the drying section housing 14A, a plurality of conveyor rollers 42 are disposed in a zigzag or alternately staggered fashion while they are rotatably supported to the housing 14A. These conveyor rollers 42 define together a path for conveying the sheet S forward therealong. A drive unit is cooperatively coupled to the rollers 42 through drive shafts and gears as will be later described in FIG. 5. Then the driving force of the drive unit is transmitted to the rollers 42 to rotate the rollers 42 for conveying the sheet S (which has arrived at the drying section 14) vertically downward as viewed in FIG. 1. Near the bottom of the drying section housing 14A are disposed a guide roller 46 having a larger diameter than the rollers 42 and a pair of guide rollers 44 cooperating therewith preferably of the same diameter as the rollers 42. These rollers 44 and 46 are also rotatably supported to the housing 14A. The driving force of the drive unit is also transmitted to the rollers 44 and 46 for reversing the movement of the sheet S (which has been guided to the bottom) toward an outlet 38 provided in the housing 14A whereby the sheet is delivered outward to a receptacle 40 attached to one side wall of the casing 10 which is common to the outer wall of the housing 14A in the embodiment illustrated in FIG. 1.

As mentioned above, a plurality of conveyor rollers 42 are disposed in a zigzag or alternately staggered fashion. The vertically spaced apart rollers 42 are alternately disposed on opposite sides of the sheet path, and the rollers 42 on one side are in contact with the face surface of sheet S and the rollers 42 on the other side are in contact with the rear surface of sheet S. More particularly, the rollers 42 are alternately arranged or staggered so that provided that the rollers 42 are in contact with the face and rear surfaces of sheet S, the plane connecting the axis of one roller 42 in contact with the face surface of sheet S at a certain position and the axis of the adjacent roller in contact with the rear surface of sheet S at a vertically spaced apart position is not perpendicular to the sheet S.

Figure 2:
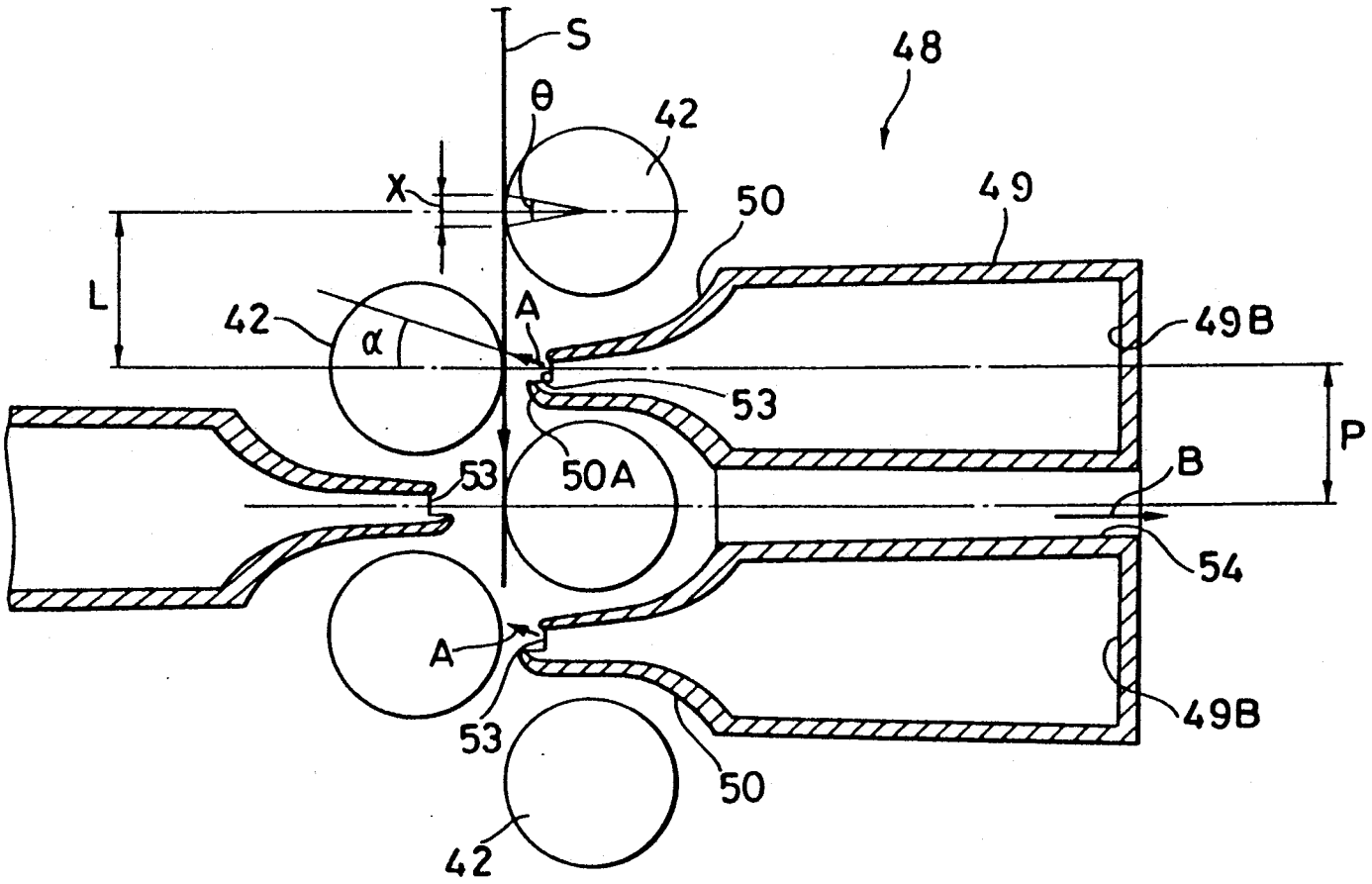
FIG. 2 schematically illustrates a portion of the drying section in the processor of FIG. 1.

FIG. 2 is an enlarged view illustrating some of the rollers 42 defining the path for conveying the sheet S therealong in the interior of the drying section housing 14A. Two oppositely disposed rollers 42 are vertically spaced a distance L (in mm). More specifically, L is the distance between the axes of the two adjacent rollers 42. The rollers 42 are arranged to meet the following relationship:

$$k_1M+0.5<L<(k_1+1)M-0.5 \quad (1)$$

wherein M is the distance (in mm) over which the sheet S is fed per revolution of the drive shaft for driving the rollers 42 for rotation, and $k_1$ is equal to 0 or an integer of 1 to 8.

If the sheet to be dried in the drying section is fed forward smoothly without a speed variation, then no drying marks occur. In practice, however, during one revolution of the drive shaft for conveying the sheet forward, the rotation speed includes a variation in an infinitesimal time and it can be considered that the sheet stops in an extra infinitesimal time on the conveyor roller. As a result, only the area of the sheet covered by the roller is intensely dried on the roller which is heated with drying air.

Figure 3A:
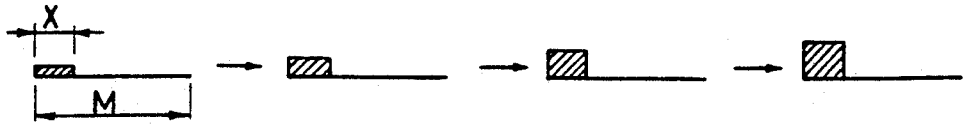
FIGS. 3*a* and 3*b* diagrammatically illustrate the location of rollers and the extent of drying.
Figure 3B:
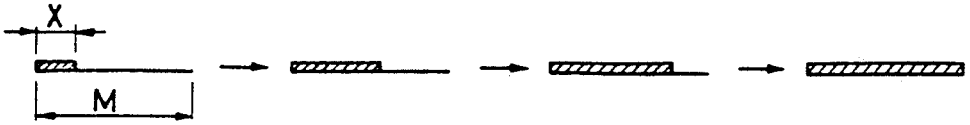

The relationship (1) is derived for the following reason. Assume that the distance over which the conveyor roller is in contact with the sheet is X (in mm) which corresponds to a contact angle $\theta$, and excess heat is applied to an area of distance X as shown in FIG. 3*a*. It is to be noted that X is about 1 to 3 mm and $\theta$ is about 5° to 15° in most cases. If L (mm) is equal to an integral multiple of M (mm), then application of excess heat to the area of X is repeated at every roller contact so that the amount of excess heat is accumulated as shown in FIG. 3(*a*) where $L=k_1 \cdot M$, resulting in the limited area of the sheet being intensely dried. This local drying phenomenon becomes prominent with an increased drying capability.

It is then recommended that the distance L (mm) between adjacent rollers be off an integral multiple of M (mm). The minimum of this displacement is 0.5 mm. With this displacement, as shown in FIG. 3(*b*) where $L \neq k_1 \cdot M$, the sheet is dried everywhere to a substantially equal extent while passing several rollers, thus eliminating drying marks.

Preferred is the relationship:

$$k_1M+0.7 \leqq L \leqq (k_1+1)M-0.7 \quad (1a)$$

and more preferred is the relationship:

$$k_1M+1 \leqq L \leqq (k_1+1)M-1 \quad (1b)$$

The upper limit of $k_1$ is not limited in theory as long as it is a positive integer. In consideration of the drying time and the overall length of the transfer path, $k_1$ is preferably 0 or 1 to 6. In determining L in accordance with relationship (1), $k_1$ and $k_1$ in $(k_1+1)$ are of the same value.

The embodiment illustrated in FIG. 1 includes twelve (12) rollers although the number of rollers is generally 4 or more, preferably 6 to 30. Less rollers fail to achieve full drying or offset drying unevenness.

The roller-to-roller distances L (mm) may be identical among all the rollers or different although provision should be made for every portion of the sheet S being dried to receive an equal amount of heat or hot air.

In connection with relationship (1), either a combination of L variants determined from the same $k_1$ or a combination of L variants determined from different $k_1$'s may be employed. Any suitable combination should preferably be selected such that the length of the transfer path through the drying section 14 is not too long as compared with that obtained with identical L. It is also possible to use a combination of L variants which is obtained by first determining a L value satisfying relationship (1) and then altering the L value within the range of satisfying relationship (1) for a drying process over a length of 2Y/3 including the last half of the effective drying section wherein Y is the length (in mm) of an area where the rollers 42 can affect drying of the sheet S (or the effective drying path length in the drying section). (See Japanese Patent Application No. 401172/1990.)

In the practice of the invention, L is generally in the range of about 10 to 80 mm, preferably about 10 to 60 mm, and M is generally in the range of about 1.5 to 30 mm, preferably about 2 to 20 mm. It is to be noted that the rollers generally have a diameter of about 10 to 40 mm, preferably about 15 to 30 mm, more preferably about 18 to 25 mm.

Figure 4:
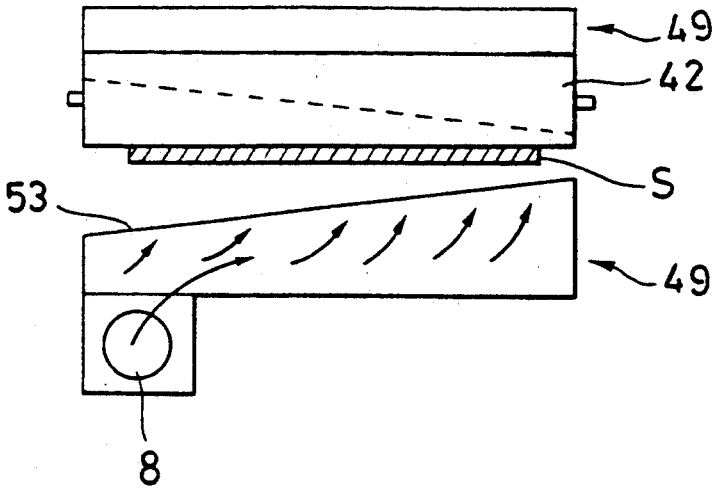
FIG. 4 is a plane view of a portion of the drying section showing the slit pipe/nozzle and roller relative to a sheet of photosensitive material.

Also as shown in FIGS. 1 and 2, the drying section 14 includes hot air injectors in the form of slit pipe assemblies 48 in proximity to the rollers 42. In the embodiment shown in FIG. 1, six slit pipe assemblies 48 are arranged on opposite sides of the sheet transfer path, with three assemblies on each side. Each slit pipe assembly 48 includes a pair of slit or flat pipes 49 having a longitudinal direction perpendicular to the surface of the sheet of FIG. 2 and a transverse direction which is lateral in FIG. 2. The slit pipes 49 are arranged with their longitudinal direction aligned with the transverse direction of the sheet S and have a longitudinal size larger than the transverse size of the sheet S as shown in FIG. 4. Each slit pipe 49 is provided with an opening 49B at one longitudinal end to which hot air is delivered from a hot air supply 8 (see FIG. 4) which includes a fan 60 and a heater to be described later.

Each slit pipe 49 is provided with a hot air nozzle 50 which transversely protrudes toward the sheet S transfer path and extends longitudinally of the slit pipe. The nozzle 50 has a hollow interior in communication with the interior of the slit pipe 49. The nozzle 50 is tapered to define a slit orifice 53. More particularly, each nozzle 50 includes an upper lip which is tapered curvilinearly to a transverse distal end and a lower lip which is tapered curvilinearly to a transverse distal end 50A which is rounded up as seen from FIG. 2. The transverse size of the slit pipe (the lateral size in FIG. 2) is gradually increased from one longitudinal end where the opening **48*b* to the hot air supply 8 is located toward the opposite longitudinal end (see FIG. 4**).

Like the rollers 42, the slit nozzles 50 are alternately staggered on opposite sides of the sheet transfer path. Two oppositely disposed slit nozzles 50 are vertically spaced a distance P (in mm). More specifically, P is the distance between the center axes of the two adjacent slit nozzles 50 or orifices 53 as shown in FIG. 2. The slit nozzles 50 or orifices 53 are arranged to meet the following relationship:

$$k_2M+0.5<P<(k_2+1)M-0.5 \quad (2)$$

wherein M is as defined for (1), and $k_2$ is equal to 0 or an integer of 1 to 8.

Relationship (2) is derived for the same reason as in the case of relationship (1) except that it is herein intended to eliminate any difference in strength of drying at the site of contact of hot air exiting from the slit nozzles 50.

Like relationship (1), preferred is the relationship:

$$k_2M+0.7 \leqq p \leqq (k_2+1)M-0.7 \quad (2a)$$

and more preferred is the relationship:

$$k_2M+1 \leqq p \leqq (k_2+1)M-1 \quad (2b)$$

The range of $k_2$ is given for the same reason as above, with $k_2$ being preferably 0 or 1 to 6. In determining P in accordance with relationship (2), $k_2$ and $k_2$ in $(k_2+1)$ are of the same value.

The hot air exiting the orifice 53 of the slit pipe 49 is blown in the direction of arrow A and substantially uniformly along the transverse direction of the sheet S. Although the embodiment of FIG. 2 is shown as injecting hot air in a direction opposite to the feed direction of the sheet S, the invention is not limited thereto. Hot air may be injected in the same direction as or perpendicular to the feed direction of the sheet S or alternately in the same and perpendicular directions (see JP-A 123236/1989 and 265855/1991 and Japanese Patent Application No. 401172/1990). However, for efficient evaporation of water from the sheet surfaces, hot air is preferably injected against the feed direction of the sheet S as in the illustrated embodiment.

Hot air is generally injected at an angle ($\alpha$) relative to the normal to the feed direction of the sheet S of 1° to 60°, preferably 2° to 30°, more preferably 2° to 20°. Often hot air is blown at a velocity of 12 to 15 m/sec. and a flow rate of 6 to 15 $m^3$/min., preferably 8 to 12 $m^3$/min., more preferably 9 to 11 $m^3$/min. The air temperature is 40 to 80° C., preferably 45° to 75° C., more preferably 50° to 70° C. P is generally about 10 to 80 mm, preferably about 10 to 60 mm.

The nozzle-to-nozzle distances P (mm) may be identical among all the slit nozzles or different. In connection with relationship (2), either a combination of P variants determined from the same $k_2$ or a combination of P variants determined from different $k_2$'s may be employed.

In the embodiment illustrated in FIGS. 1 and 2, the injector nozzles 50 and the rollers 42 are alternately arranged on each side of the sheet transfer path and the injector nozzles on one side are generally opposed to the respective rollers on the opposite side. Preferably each injector nozzle 50 is positioned near the center of contact between the sheet S and the roller 42 opposed to the nozzle 50 for promoting evaporation of water which is otherwise likely to stagnate near the point of contact. Then L is equal to P in most cases. Differently stated, L and P may be determined using an equal value of $k_1$ and $k_2$.

However, the present invention is not limited to this preferred embodiment and the injector nozzles 50 or orifices 53 need not be necessarily positioned near the above-mentioned center of contact. Then L meeting relationship (1) and P meeting relationship (2) may be independently determined. Differently stated, L and P may be determined using different values of $k_1$ and $k_2$.

The embodiment illustrated in FIG. 1 includes twelve (12) nozzles although the number of nozzles is generally 4 or more, preferably 6 to 30. Less nozzles fail to achieve full drying or offset drying unevenness.

The spacing between the sheet S and the orifices 53 of the slit pipes 49 is generally about 1 to 15 mm, preferably about 2 to 10 mm. The spacing may be kept constant or varied in the longitudinal direction of the slit pipes 49 or orifices 53. Preferably the spacing is linearly reduced from the largest spacing at the longitudinal one end connected to the hot air supply 8 to the smallest spacing at the longitudinal opposite end as shown in FIG. 4 for ensuring even drying of the sheet S in its transverse direction. Of course, it is preferred to vary the spacing within the above-mentioned range.

The slit orifice 53 generally has a width of about 1 to 5 mm, preferably about 2 to 4 mm.

The slit pipe assembly 48 also includes a slit duct 54 disposed between its pair of slit pipes 49 for providing fluid communication between transversely opposite ends. The slit duct 54 is coextensive with the slit pipes 49 in both the longitudinal and transverse directions thereof and effective for discharging air from near the sheet feed path to the rear side in the direction of arrow B.

The present invention requires that either one of relationships (1) and (2) is satisfied although it is preferred that both are satisfied.

The conveyor rollers 42 in the drying section 14 are driven by a drive system built in the processor 1. The drive system is schematically shown in FIG. 5.

Figure 5:
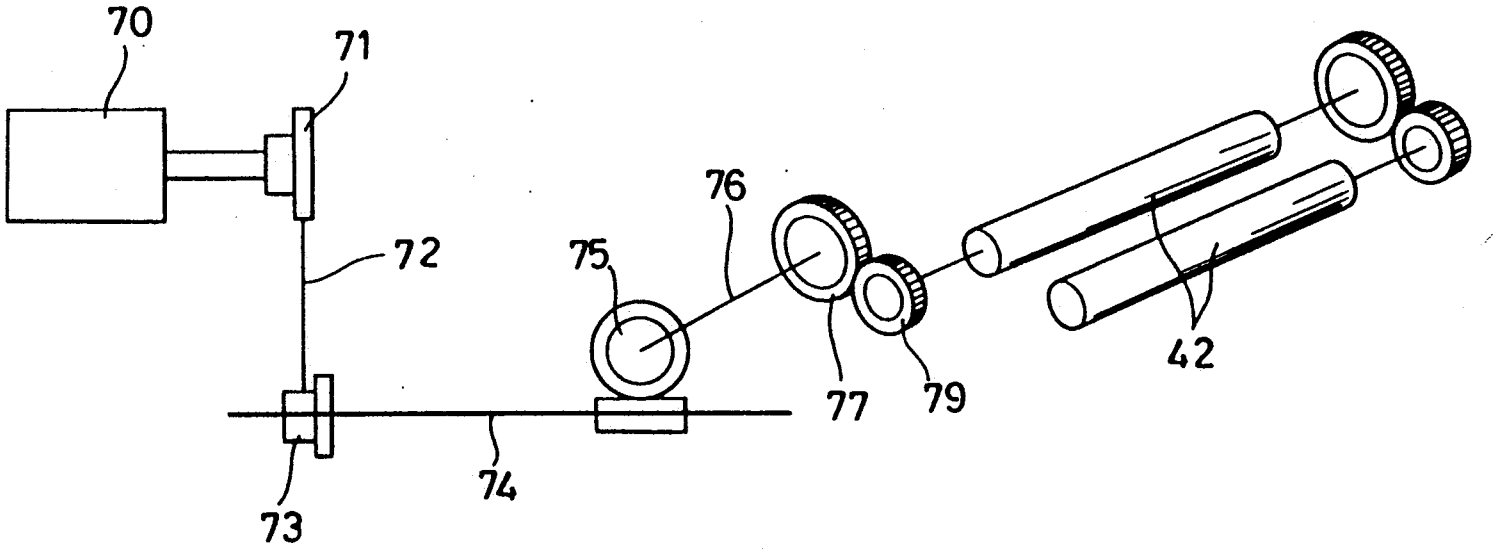
FIG. 5 is a schematic perspective view of one exemplary roller driving system.

Referring to FIG. 5, the drive system includes a drive motor 70 having a motor shaft, a gear 71 attached to the motor shaft, a chain 72, a gear 73 coupled with the gear 71 through the chain 72, a drive shaft 74 having the gear 73 and a spline gear secured thereto, a bevel gear 75 in mesh with the spline gear on the drive shaft 74, another drive shaft 76 having the bevel gear 75 and a gear 77 secured thereto, and a gear 79 in mesh with gear 77, the gear 79 being directly coupled to the shaft of the roller 42. Through this drive system, the roller 42 is driven for rotation by the driving force of the drive motor 70.

In the drive system, the meshing operation between gears 77 and 79 for transmitting the driving force involved in the process from the drive shaft 74 to the roller 42 includes a variation in rotational speed as determined in an infinitesimal time, as previously discussed in connection with the conveyor roller 42.

Any suitable one of the gears driven by the drive shafts 74 and 76, for example, gear 79 has a plurality of teeth. N is the distance (in mm) over which a sheet S of photosensitive material is fed per rotational movement of the gear 79 by one tooth. In the practice of the invention, the conveyor rollers 42 are preferably arranged in the drying section so as to satisfy the relationship represented by the following formula (3):

$$k_3N+0.5<L<(k_3+1)N-0.5 \quad (3)$$

wherein $k_3$ is an integer of 1 to 20.

This relationship is derived for a similar reason to the above-mentioned relationship (1) such that the roller-to-roller distance L is not an integral multiple of the distance N (mm) over which a sheet S is fed by one tooth of the rotating gear.

Preferred is the relationship:

$$k_3N+0.7\leqq L\leqq(k_3+1)N-0.7 \quad (3a)$$

and more preferred is the relationship:

$$k_3N+1\leqq L\leqq(k_3+1)N-1 \quad (3b)$$

The range of $k_3$ is given for the same reason as $k_1$ and $k_2$ for relationships (1) and (2), with $k_3$ being preferably 1 to 18. In determining L in accordance with relationship (3), $k_3$ and $k_3$ in $(k_3+1)$ are of the same value.

The L value determined from relationship (3) should be compliant with the L value determined from relationship (1). The invention has a preference for relationship (1) over relationship (3).

In practice, N is generally about 1 to 10 mm, preferably about 2 to 6 mm.

Referring to FIG. 1 again, the processor includes a discharge port 56 defined at the bottom of the drying section housing 14A and a fan 60 disposed at the bottom of the processor housing 10. A return duct 58 is connected at one end to the port 56 and at another end to the suction port of the fan 60. A suction duct 62 is also connected to the suction port of the fan 60. The processor further includes a vent 61 connected to the drying section housing 14A and opening to the exterior of the processor housing for discharging humid air from within the drying section 14. The nozzles 50 inject hot air against the sheet S whereupon the hot air is fed back through the slit ducts 54 in the slit pipe assemblies 48, drawn to the bottom of the drying section housing 14A, and then partially discharged out of the processor housing 10 through the vent 61. The remaining portion of the hot air at the bottom of the drying section housing 14A is channeled to the suction port of the fan 60 through the port 56 and return duct 58 while the fan 60 receives at its suction port fresh air from the exterior through the suction duct 62.

Then the fan 60 at its suction port receives air as a mixture of humid warm air channeled from the drying section 14 and fresh air taken in from the exterior. A proper choice of the flowpath cross-sectional areas of the return duct 58 and the suction duct 62 allows the air mixture to consist of about 80% by volume of humid warm air from the drying section 14 and about 20% by volume of fresh air.

Figure 6:
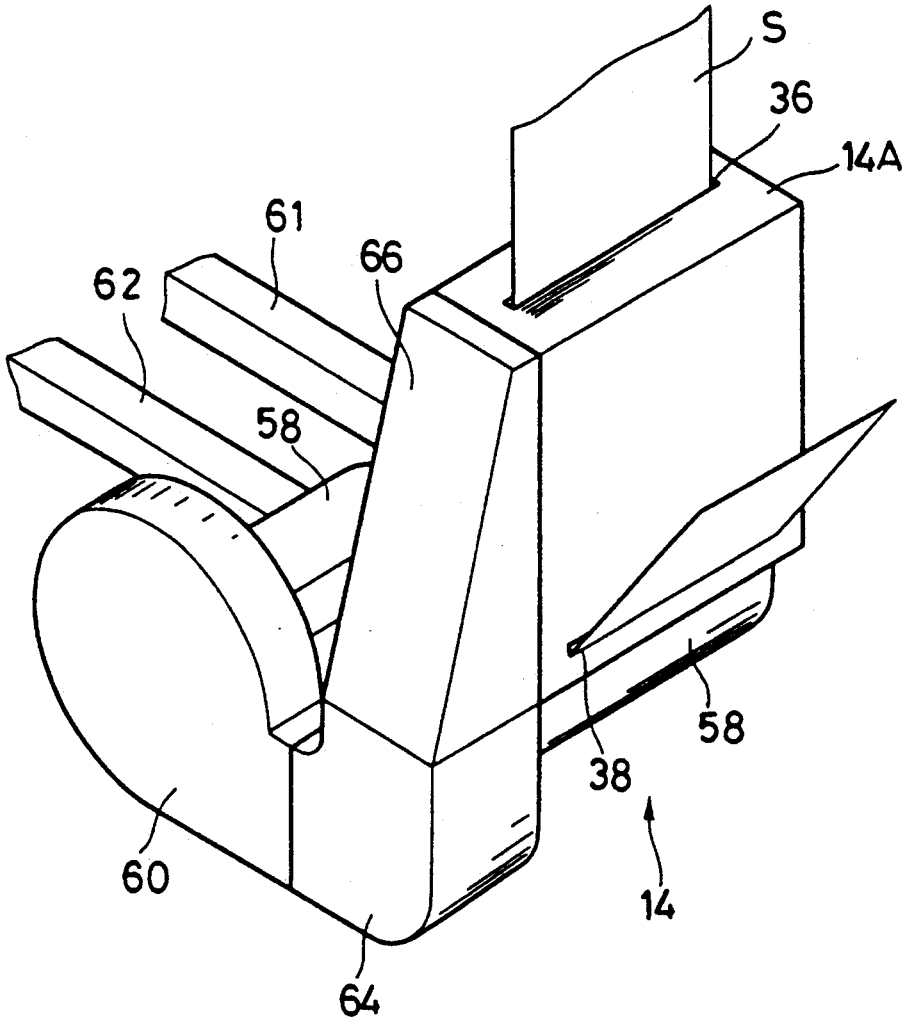
FIG. 6 is a perspective view of one exemplary blower unit.

FIG. 6 isometrically illustrates the fan 60 and the drying section 14 in combination. The fan 60 has a discharge port connected to the drying section 14 through a heater box 64 and a manifold 66. The heater box 64 has a heater (not shown) disposed therein and is of an elbow shape. The manifold 66 is connected to the outlet port of the elbow shaped heater box 64. The fan 60 draws air at its suction port and discharges air from the discharge port to the heater box 64 where it is heated into hot air.

The manifold 66 is attached to the drying section 14 in a side by side relationship along the feed direction of a sheet S of photosensitive material. The manifold 66 includes a plurality of distribution ports (not shown) which are connected to the openings 49B of the slit pipe assemblies 48, respectively (see FIGS. 1 and 2). Then respective slit pipes 49 are in fluid communication with the manifold 66 so that the hot air is delivered from the heater box 64 to the slit pipes 49. Also as shown in FIG. 6, the manifold 66 has a flowpath cross-sectional area which is gradually reduced along its longitudinal direction or the feed direction of sheet S. The tapered flowpath area of the manifold 66 insures that the vertically spaced slit pipes 49 receive hot air at a substantially equal flow rate per unit time.

Figure 7:
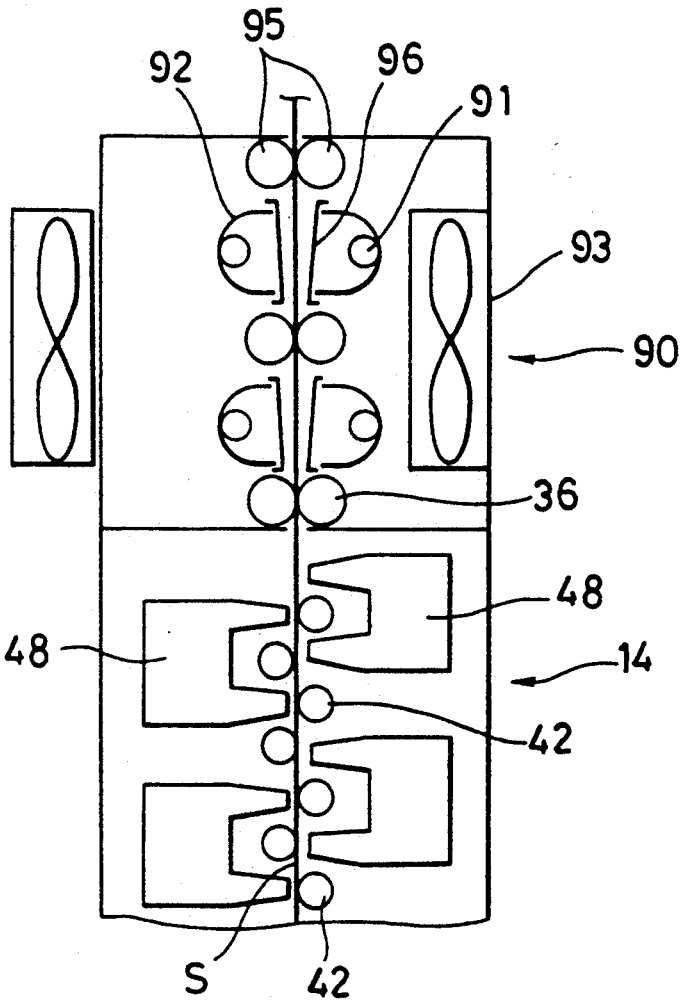
FIG. 7 schematically illustrates a modified arrangement of the drying section using far-infrared heaters.

In another preferred embodiment of the invention, as shown in FIG. 7, a pre-drying section 90 is provided in front of the drying section 14 for further improving the drying capacity. The pre-drying section 90 includes a far-infrared heater so that the sheet S may be pre-dried by means of the far-infrared heater prior to the drying in the drying section 14 in accordance with the invention.

More particularly, the pre-drying section 90 includes vertically spaced pairs of rollers 95 and guide plates 96 for feeding the sheet S forward. In proximity to the guide plates 96 are disposed far-infrared heaters 91 and reflectors 92 enclosing the heaters. Also included are fans 93 for drawing in and discharging air for passing air through the pre-drying section 90.

The drying by far-infrared heaters is not limited to the arrangement shown in FIG. 7. And the pre-drying section may be located at the end of the squeeze section or as the initial stage of the drying section. For the far-infrared heater drying, reference is made to JP-A 264959/1991, 265854/1991 and 265855/1991.

Figure 8:
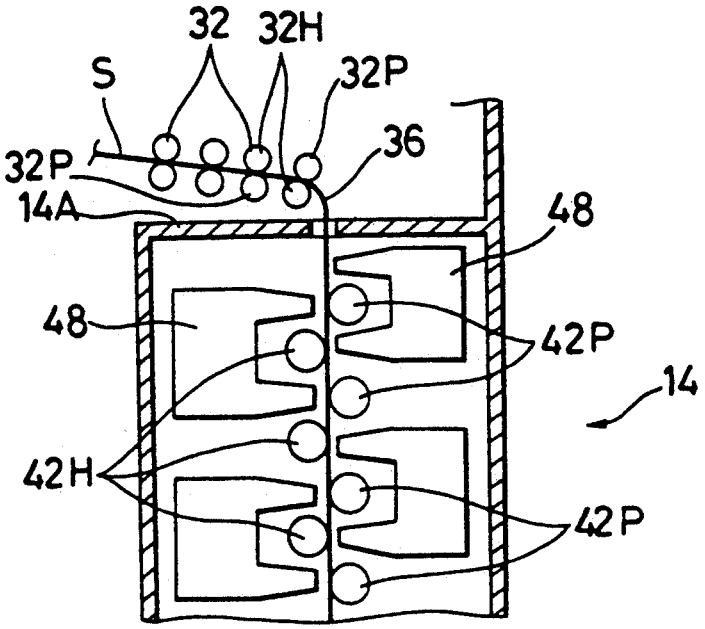
FIG. 8 schematically illustrates another modified arrangement of the drying section using heat rollers.

Also for the purpose of increasing the drying capacity, as shown in FIG. 8, some of the squeeze rollers 32 and optionally some of the rollers 42 in the drying section 14 may be replaced by heat rollers 32H and heat rollers 42H, respectively.

In the embodiment shown in FIG. 8, the last four rollers among the squeeze rollers 32 are alternately heat rollers 32H and press rollers 32P, and the rollers 42 in the drying section 14 are alternately heat rollers 42H and press rollers 42P, as viewed from the upstream side of the sheet transfer path.

Figure 9:
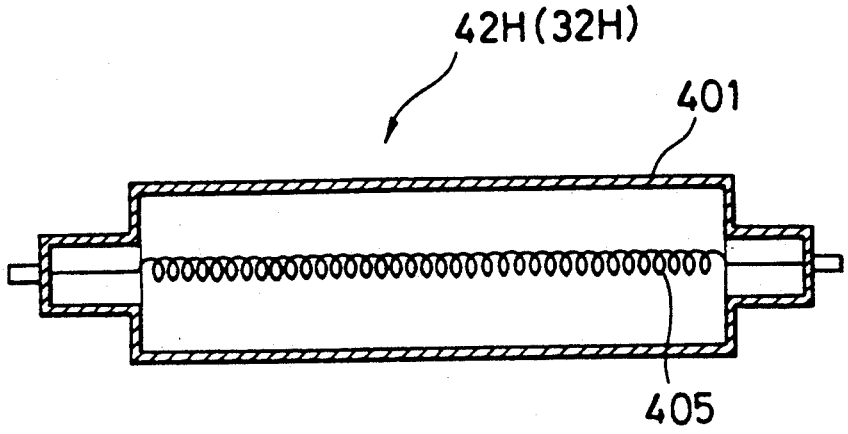
FIG. 9 is a cross sectional view of one exemplary heat roller used in FIG. 8.

The heat rollers 42H or 32H may be rollers having built therein a heat source in the form of a nichrome wire heater or halogen lamp or self-heating rollers. One exemplary heat roller is shown in FIG. 9 as a roller 401 in the form of a metallic cylinder of aluminum or the like in which a nichrome wire heater 405 is axially extended. The heat rollers 42H or 32H may have a surface temperature of about 50° to 150° C.

The processing section of the processor used herein is not limited to that shown in FIG. 1. For example, rinse tanks full of rinse water may be disposed in proximity to the crossover rollers 30 between the developing and fixing tanks 18 and 20 and between the fixing and washing tanks 20 and 22. Each rinse tank is positioned below a pair of crossover rollers 30 such that the lower roller is partially immersed in the rinse water. Rinse water is replenished to the rinse tanks. The provision of the rinse tanks minimizes carry-over of the processing solution from one tank to the subsequent tank and allows for easy maintenance by cleaning the crossover rollers 30 with rinse water. The rinse tanks are more effective when a fixer solution containing an aluminum salt hardener is used.

The developer used herein may or may not contain a hardener. The developer free of a dialdehyde hardener may be prepared as a concentrate of one or two part type. When photographic silver halide photosensitive materials have a swelling factor of at least 180%, especially at least 200% as defined in JP-A 11193/1983, the developer used in processing these photosensitive materials should preferably be an alkaline developer containing a dialdehyde hardener.

The dialdehyde hardeners used herein are preferably dialdehydes and bisulfite salt adducts thereof. Examples include glutaraldehyde, α-methylglutaraldehyde, β-methylglutaraldehyde, maleindialdehyde, succindialdehyde, methoxysuccindialdehyde, methylsuccindialdehyde, α-methoxy-β-butoxyglutaraldehyde, α-n-butoxysuccindialdehyde, α,α-dimethoxysuccindialdehyde, α,α-diethylsuccindialdehyde, β-isopropylsuccindialdehyde, butylmaleindialdehyde or bisulfate salt adducts thereof. The dialdehyde hardening agent is preferably used in an amount of 1 to 20 grams, especially 2 to 15 grams per liter of the developer.

The alkaline developer is preferably at pH 9 to 13, especially pH 9.5 to 12. Alkaline agents are used for pH adjustment. Included are water-soluble inorganic alkali metal salts such as sodium hydroxide, sodium carbonate, potassium carbonate, sodium tertiary phosphate, and potassium tertiary phosphate. Buffer agents are also useful, for example, borates as disclosed in JP-A 186259/1987, saccharides (e.g., saccharose), oximes (e.g., acetoxime), phenols (e.g., 5-sulfosalicylic acid), tertiary phosphates (e.g., sodium and potassium salts), and carbonates as disclosed in JP-A 93433/1985.

The fixer used herein is generally controlled to pH 4.6 or higher, preferably pH 4.6 to 6.0, more preferably pH 4.7 to 5.5 as measured with running equilibrium solution. The running equilibrium solution is a fixer solution working in the fixing tank after a fixer replenisher has been supplied in a volume twice the tank volume.

The fixer may or may not contain an aluminum salt hardener. When a fixer containing an aluminum salt hardener is used, photographic silver halide photosensitive materials should preferably have a swelling factor of up to 250%, especially 100 to 250%, more preferably 120 to 230%, most preferably 150 to 230%. When the fixer used is free of an aluminum salt hardener, photographic silver halide photosensitive materials should preferably have a swelling factor of up to 200%, especially up to 180%. The fixer gives off minimized odor and provides minimized corrosion of the processing equipment and the surrounding environment. Since the fixer has a relatively weak hardening effect, increased drying loads are imposed on the photosensitive material being processed therewith. Even so, the present invention uses a sophisticated drying process as defined above, accomplishing effective drying while eliminating locally uneven drying and drying marks.

A fixer replenisher should have a lower pH than the running equilibrium solution in order to compensate for a carry-over of the alkaline developer to the fixing tank. The fixer replenisher need not be extremely low in pH and is generally in the range of pH 4.5 to 5.2. This pH range makes it unnecessary to separate a part mainly containing a thiosulfate and a part mainly containing an aluminum salt hardener. Then the fixer replenisher can be formulated as a one part kit. The replenisher received in a replenishment kit as a concentrate is of one part composition and thus requires only a simple step of diluting it with water, leading to ease of solution preparation procedure. In some cases, a kit is prepared as a working fixer solution rather than a concentrate. The advantage of easy solution preparation is also available because of the one part composition.

In the practice of the invention, the fixer replenisher is preferably supplied at a rate of 0.05 to 0.6 liters, more preferably 0.05 to 0.5 liters, most preferably 0.1 to 0.4 liters per square meter of the photosensitive material. The present invention is advantageously applicable to such a reduced replenishment mode.

The processing method of the present invention is adapted for rapid processing and generally includes a series of developing, fixing, washing and drying steps. The rapid processing means that the time taken from development to drying is generally 20 to 90 seconds, preferably 20 to 70 seconds, more preferably 20 to 60 seconds, and most preferably 20 to 50 seconds.

The developer contains a developing agent, preservative, alkaline agent and other conventional agents as will be described later. The developing agent is generally a dihydroxybenzene, preferably a combination of dihydroxybenzene and 1-phenyl-3-pyrazolidone or a combination of dihydroxybenzene and p-aminophenol.

Examples of the dihydroxybenzene developing agent used herein include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with the hydroquinone being preferred. Examples of the p-aminophenol developing agent used herein include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol, with the N-methyl-p-aminophenol being preferred. Examples of the 1-phenyl-3-pyrazolidone developing agent used herein include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-toly-4-methyl-4-hydroxymethyl-3-pyrazolidone. Instead of the hydroquinone, reductones may be used as the deveoping agent as described in Japanese Patent Application Nos. 352929/1991 and 70366/1992 by the same assignee as the present invention. The developing agent is preferably used in an amount of about 0.01 to 1.2 mol/liter.

The sulfite preservative in the developer includes sodium sulfite, potassium sulfite, lithium sulfite, ammonium sulfite, sodium bisulfite, and potassium metabisulfite. The sulfite is generally used in an amount of at least about 0.2 mol/liter, especially at least 0.4 mol/liter. The preferred upper limit is 2.5 mol/liter.

Additives used other than the above-mentioned components include chelating agents such as aminopolycarboxylic acids, aminophosphonic acids, and phosphonic acids; development retarders such as sodium bromide and potassium bromide; organic solvents such as ethylene glycol, diethylene glycol, triethylene glycol and dimethylformamide; and antifoggants, for example, mercapto compounds such as 1-phenyl-5-mercaptotetrazole and 2-mercaptobenzimidazole, and indazole compounds such as 5-nitroindazole, and benzotriazole compounds such as 5-methylbenzotriazole. Also added are development promoters as disclosed in Research Disclosure, Vol. 176, No. 17643, Item XXI (December 1978), and if desired, color toning agents, surfactants, anti-foaming agents, and water softeners. Anti-silver-sludging agents may be added to the developer, for example, the compounds described in JP-A 24347/1981 and Japanese Patent Application No. 187700/1989. To the developer may be added amino compounds, for example, alkanol amines as described in EP-A 01 36 582, UK Patent No. 958,678, U.S. Pat. No. 3,232,761, and JP-A 106244/1981.

The fixer used herein is an aqueous solution having pH 4.6 or higher in running equilibrium solution form and containing a thiosulfate fixing agent. The fixing agent includes sodium thiosulfate and ammonium thiosulfate, with the ammonium thiosulfate being preferred for fixing speed. The amount of the fixing agent used may vary over a wide range and is generally from about 0.1 to 6 mol/liter.

As previously mentioned, the fixer may contain a water-soluble aluminum salt as the hardener. Examples of the aluminum salt hardener include aluminum chloride, aluminum sulfate and potassium alum. The hardener is preferably added in an amount of 0.01 to 0.2 mol/liter, more preferably 0.03 to 0.08 mol/liter.

The fixer may contain tartaric acid, citric acid, gluconic acid or derivatives thereof alone or in admixture, preferably in an amount of at least 0.005 mol/liter, more preferably 0.01 to 0.03 mol/liter.

In addition to the above-mentioned components, the fixer may contain preservatives (e.g., sulfites and bisulfites), pH buffer agents (e.g., acetic acid, citric acid and boric acid), pH adjusting agents (e.g., sulfuric acid), chelating agents, and the like, if desired. The pH buffer agents when used are preferably added in an amount of 10 to 60 g/liter, more preferably 18 to 25 g/liter since the developer has high pH. The fixer may further contain a compound which assists in leaching the sensitizing dye out of the photosensitive material, for example, the compounds described in EPA 341637, JP-A 4739/1988 and 15734/1988. These compounds become more effective with a reduced replenishment rate of the fixer, particularly when the amount of iodide ion in running equilibrium solution exceeds 0.6 mmol/liter in the context that the amount of iodide ion in the fixer increases as the replenishment rate of the fixer is reduced.

In the practice of the invention, the fixer is preferably replenished at a rate of 0.05 to 0.6 liters, more preferably 0.05 to 0.5 liters, most preferably 0.1 to 0.4 liters per square meter of photosensitive material.

When the running equilibrium fixer solution has a higher pH than usual as often occurs in the present invention, the fixer should preferably contain a pH buffer agent (e.g., acetic acid and boric acid) in a higher concentration than usual. Although the fixer usually contains a pH buffer agent in a concentration of about 0.3 mol/liter, the fixer used in the invention should preferably have a concentration of at least 0.5 mol/liter, especially 0.5 to 0.8 mol/liter of a pH buffer agent. For reducing the influence of a carry-over of the developer, it is also effective to place a rinse or acidic bath between the developing and fixing tanks.

Subsequent to the developing and fixing steps, the photosensitive material is processed with washing water or stabilizing solution which may be replenished at a rate of up to 3 liters per square meter of the photosensitive material (inclusive of 0 indicating batchwise tank water). This enables processing with water savings, and piping upon installation of the processor becomes unnecessary. Although washing water is used in the illustrated embodiment, processing with a stabilizing solution is also acceptable.

Although only one washing tank is used in the illustrated embodiment, any suitable means for reducing the amount of washing water replenished can be applied to the invention. One such well-known means is a multistage (e.g., two or three stage) counter-flow system. This system accomplishes efficient washing since the photosensitive material after fixation comes in contact with a series of clearer washing water portions, that is, water portions which are less contaminated with the fixer as the photo-sensitive material proceeds forward.

In the case of the washing process with water savings or non-piping washing process, anti-bacterial means is preferably applied to washing water or stabilizing solution. The anti-bacterial means includes irradiation of ultraviolet radiation as disclosed in JP-A 263939/1985; application of a magnetic field as disclosed in JP-A 263940/1985; blowing of ozone as described in Somiya ed., "Ozone Utilizing Treatment", Kogai Taisaku Gijutu Doyukai, 1989; the methods disclosed in Japanese Patent Application Nos. 309915/1989 and 208638/1990; the use of ion-exchange resins to purify water as disclosed in JP-A 131632/1986; and anti-bacterial agents as disclosed in JP-A 115154/1987, 153952/1987, 220951/1987 and 209532/1987. Also useful are anti-fungal agents, anti-bacterial agents and surfactants as described in L. E. West, "Water Quality Criteria", Photo. Sci. & Eng., Vol. 9, No. 6 (1965); M. W. Beach, "Microbiological Growths in Motion-Picture Processing", SMPTE Journal, Vol. 85 (1976); R. O. Deegan, "Photo Processing Wash Water Biocides", J. Imaging Tech., 10, No. 6 (1984); and JP-A 8542/1982, 58143/1982, 97530/1982, 132146/1982, 157244/1982, 18631/1983, and 105145/1983.

In the washing and stabilizing baths, there may be added in combination with microbiocides, the isothiazolines described in R. T. Kreiman, J. Image, Tech 10 (6), 242 (1984), the isothiazolines described in Research Disclosure, Vol. 205, No. 20526 (May 1981), the isothiazolines described in Research Disclosure, Vol. 228, No. 22845 (April 1983), the compounds described in JP-A 209532/1987, and the silver ion releasing agents described in Japanese Patent Application No. 91533/1989. Other useful compounds are described in Horiguchi, Hiroshi, "Bokin Bobai no Kagaku", Sankyo Publishing K.K., 1982, and Nippon Bokin Bobai Society, "Bokin Bobai Gijutu Handbook (Antifungal & Antibacterial Engineering Handbook)", Hakuhodo K.K., 1986.

Where washing is done with a smaller amount of water in the practice of the invention, it is preferred to place squeeze roller washing tanks as disclosed in JP-A 18350/1988 or to employ a washing arrangement as disclosed in JP-A 143548/1988.

Overflow solution exits from the washing or stabilizing bath as water having any anti-bacterial means applied thereto is replenished with the progress of processing. Part or all of the overflow solution may be used as a processing solution having a fixing function in the preceding step as disclosed in JP-A 235133/1985.

While the photographic silver halide photosensitive material is processed according to the invention in an automatic processor including at least developing, fixing, washing (or stabilizing) and drying steps as mentioned above, the overall process from development to drying should preferably completed within 90 seconds. More specifically, the time taken from the start point of time when the leading edge of a photosensitive material film or sheet enters the developer, past the fixing, washing (or stabilizing) and drying steps, to the end point of time when the leading edge exits the drying section, which is known as a dry-to-dry time, is within 90 seconds, preferably within 70 seconds, more preferably within 60 seconds, most preferably within 50 seconds.

Several terms are defined in conjunction with a sequence of successively processing a length or sheet of photosensitive material through a developing tank, a fixing tank, a washing tank, and then a drying section of an automatic processor. "Developing process time" or "developing time" is a duration taken from the point when the leading edge of a photosensitive material is dipped in the developing tank liquid in the processor to the point when it is subsequently dipped in the fixer. "Fixing time" is a duration taken from the point when the leading edge is dipped in the fixing tank liquid to the point when it is dipped in the washing tank liquid (or stabilizer). "Washing time" is a duration when the photosensitive material is dipped in the washing tank liquid. "Drying time" is a duration when the photosensitive material passes through the drying section where hot air at 35° to 100° C., preferably 40° to 80° C. is usually blown.

In order to accomplish rapid processing within 90 seconds on a dry-to-dry basis, the developing time is generally within 30 seconds, preferably within 25 seconds while the developing temperature ranges from 25° to 50° C., preferably from 30° to 40° C. The fixing time generally ranges from 5 to 20 seconds at temperatures of about 20° to 50° C., preferably from 5 to 15 seconds at temperatures of about 30° to 40° C. Within this range, full fixation is done and the sensitizing dye can be leached out to such an extent that no residual color is left. For water washing or stabilizing bath, the time generally ranges from 4 to 20 seconds at temperatures of 0° to 50° C., preferably from 4 to 15 seconds at temperatures of 15° to 40° C.

Various modifications may be made to the above-mentioned system in order to complete processing of photosensitive material within 90 seconds on a dry-to-dry basis. Such modifications include the use of rubbery material rollers in the developing tank as outlet rollers to prevent uneven development inherent to rapid processing as described in JP-A 151943/1988; a developer jet flow in the developing tank at a flow speed of at least 10 m/min. for agitating the developer therein as described in JP-A 151944/1988; and more agitation during development than in standby periods as described in JP-A 264758/1988. For rapid processing, the fixing tank is preferably provided with pairs of opposing rollers as illustrated in FIG. 1 in order to increase the fixing speed. The use of opposing rollers reduces the number of rollers and hence the size of the fixing tank, which leads to a more compact processor.

The photographic silver halide photosensitive materials which can be processed by the method of the invention are not particularly limited, but are generally black-and-white photosensitive materials although color photosensitive materials are also acceptable. Examples are photographic materials for medical image laser printers, photosensitive materials for printing scanners, medical direct radiography X-ray-sensitive materials (referred to in the illustrated embodiment), medical indirect radiography X-ray-sensitive materials, and CRT image recording photosensitive materials. The invention is especially useful in the processing of black-and-white photosensitive materials for observing silver images.

With respect to various chemical components in photosensitive materials used herein, no particular limit is imposed and reference is made to JP-A 68539/1990.

| Components | JP-A 68539/1990 |
|---|---|
| Silver halide emulsion and preparation | P8/LR/L13-P10/UR/L12 |
| Chemical sensitization | P10/UR/L13-P10/LL/L16 |
| Antifoggant/stabilizer | P10/LL/L17-P11/UL/L7<br>P3/LL/L2-P4/LL |
| Spectral sensitizing dye | P4/LR/L4-P8/LR |
| Surfactant/antistatic agent | P11/UL/L14-P12/UL/L9 |
| Matte agent/lubricant/ plasticizer | P12/UL/L10-P12/UR/L10<br>P14/LL/L10-P14/LR/L1 |
| Hydrophilic colloid | P12/UR/L11-P12/LL/L16 |
| Hardener | P12/LL/L17-P13/UR/L6 |
| Support | P13/UR/L7-20 |
| Dye/mordant | P13/LL/L1-P14/LL/L9 |

(P: page. UL: upper left column. UR: upper right column. LL: lower left column. LR: lower right column. L: line)

EXAMPLE

Examples of the present invention are given below by way of illustration and not by way of limitation. PET is polyethylene terephthalate and Mw is an average molecular weight.

EXAMPLE 1

Preparation of Emulsion

To 1 liter of water were added 5 grams of potassium bromide, 25.6 grams of gelatin, and 2.5 ml of aqueous solution of 5% thioether $OH(CH_2)_2S(CH_2)_2S(CH_2)_2OH$. With stirring, an aqueous solution containing 8.33 grams of silver nitrate and an aqueous solution containing 5.94 grams of potassium bromide and 0.726 grams of potassium iodide were added to the solution maintained at 66° C. over 45 seconds by a double jet mixing method. To the solution, 2.9 grams of potassium bromide was added, an aqueous solution containing 8.33 grams of silver nitrate was added over 24 minutes and thereafter, 0.1 mg of thiourea dioxide $HN{=}C(SO_2H)—NH_2$ was added.

Then 20 ml of a 25% aqueous ammoniacal solution and 10 ml of a 50% ammonium nitrate aqueous solution were added to the emulsion, which was physically ripened for 20 minutes and then neutralized by adding 240 ml of 1N sulfuric acid.

Then an aqueous solution containing 153.34 grams of silver nitrate and an aqueous solution containing potassium bromide and potassium iodide were added to the emulsion over 40 minutes by a controlled double jet method while maintaining the potential at pAg 8.2. The flow rate was accelerated such that the flow rate at the end was 9 times the flow rate at the start of addition.

At the end of addition, 15 ml of 2N potassium thiocyanate solution was added and 45 ml of 1% potassium iodide solution was added over 30 seconds.

The temperature was then lowered to 35° C. and the soluble salts were removed by sedimentation. The temperature was raised to 40° C. again, and 76 grams of gelatin, 76 mg of proxisel and 760 mg of phenoxyethanol were added to the emulsion, which was adjusted to pH 6.50 and pAg 8.20 with sodium hydroxide and potassium bromide.

The emulsion was chemically sensitized by raising the temperature to 56° C., adding 186 mg of 4-hydroxy-6-methyl-1,3,3*a*,7-tetraazaindene, and maintaining the emulsion at the temperature for 10 minutes before 520 mg of a sensitizing dye of the following formula was added thereto.

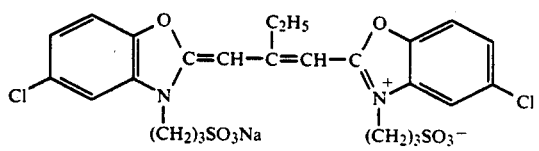

In the resulting emulsion, silver halide grains having an aspect ratio of 3 or higher occupied 99.5% of the total of the projected areas of all grains, all grains having an aspect ratio of 2 or higher had an average projected area equivalent diameter of 1.48 μm with a standard deviation of 25.6%, an average breadth of 0.195 μm and an average aspect ratio of 7.6, and the total iodine content was 1.2 mol% based on the total silver content.

Preparation of Emulsion Coating Composition

A coating composition was prepared by adding the following components to the emulsion in the amounts reported per mol of silver halide.

| Components | Amount |
|---|---|
| Polymer latex: poly(ethyl acrylate/methacrylic acid), copolymerization ratio 97/3 | 25.0 g |
| Hardener: 1,2-bis(vinylsulfonylacetamide)ethane | 3.0 g |
| 2,6-bis(hydroxyamino)-4-diethylamino-1,3,5-triazine | 80 mg |
| Sodium polyacrylate (Mw 41,000) | 4.0 g |
| Potassium polystyrenesulfonate (Mw 600,000) | 1.0 g |
| Polyacrylamide (Mw 45,000) | 24 g |

Preparation of support

A blue-tinted PET base film of 175 μm thick on either surface was coated with an undercoat layer in the following coverage.

| | |
|---|---|
| Gelatin | 84 mg/m² |
| Polymer (shown below) | 60 mg/m² |
| Dye (shown below) | 17 mg/m² |

-continued

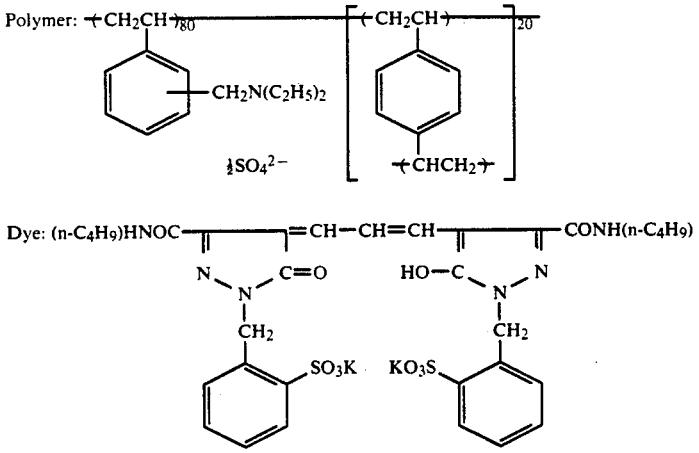

Preparation of photosensitive material

The above-mentioned emulsion coating solution and a surface protective layer coating solution of the following composition were simultaneously applied to both the surfaces of the support. The silver coverage was 1.85 g/m$^2$ on each surface. The surface protective layer coating solution was prepared by mixing the following chemicals so as to give the following coverage.

| Components | Coating weight |
|---|---|
| Gelatin | 1.15 g/m$^2$ |
| Polyacrylamide (Mw 45,000) | 0.25 g/m$^2$ |
| Sodium polyacrylate (Mw 400,000) | 0.02 g/m$^2$ |
| Sodium p-t-octylphenoxydiglyceryl-butylsulfonate | 0.02 g/m$^2$ |
| Poly(n=10)oxyethylene cetyl ether | 0.035 g/m$^2$ |
| Poly(n=10)oxyethylene/poly(n=3)-oxyglyceryl p-octylphenoxy ether | 0.01 g/m$^2$ |
| 4-hydroxy-6-methyl-1,3,3a,7-tetraazaindene | 0.0155 g/m$^2$ |
| 2-chlorohydroquinone | 0.154 g/m$^2$ |
| $C_8F_{17}SO_3K$ | 0.003 g/m$^2$ |
| $C_8H_{17}SO_2N(C_3H_7)-(CH_2CH_2O)_4-(CH_2)_4-SO_3Na$ | 0.001 g/m$^2$ |
| $C_8F_{17}SO_2N(C_3H_7)-(CH_2CH_2O)_{15}-H$ | 0.003 g/m$^2$ |
| Polymethyl methacrylate (mean particle size 3.5 μm) | 0.025 g/m2 |
| Poly(methyl methacrylate/methacrylate) (copolymerization ratio 7:3, mean particle size 2.5 μm) | 0.020 g/m$^2$ |

There was obtained a photosensitive material in which the coating had a swelling factor of 230%. It is to be noted that the swelling factor was calculated in accordance with $(b-a)/a\times 100\%$ wherein the thickness (a) of a day film was determined by observing a cut section under a scanning electron microscope (SEM) and the thickness (b) of a swollen film was determined by dipping the film in distilled water at 21° C. for 3 minutes, freeze drying it with liquefied nitrogen, and observing it under SEM.

Processing

| Preparation of concentrates | | |
|---|---|---|
| Developer concentrate | | |
| Part A | | |
| Potassium hydroxide | 330 | g |
| Potassium sulfite | 630 | g |
| Sodium sulfite | 255 | g |
| Potassium carbonate | 90 | g |
| Boric acid | 45 | g |
| Diethylene glycol | 180 | g |
| Diethylenetriamine pentaacetic acid | 30 | g |
| 1-(N,N-diethylamino)ethyl-5-mercaptotetrazole | 0.75 | g |
| Hydroquinone | 450 | g |
| Water | totaling to 4125 | ml |
| Part B | | |
| Diethylene glycol | 525 | g |
| 3,3'-dithiobishydrocinnamic acid | 3 | g |
| Glacial acetic acid | 102.6 | g |
| 5-nitroindazole | 3.75 | g |
| 1-phenyl-3-pyrazolidone | 34.5 | g |
| Water | totaling to 750 | ml |
| Part C | | |
| Glutaraldehyde (50 wt/wt %) | 150 | g |
| Potassium bromide | 15 | g |
| Potassium metabisulfite | 105 | g |
| Water | totaling to 750 | ml |
| Fixer concentrate | | |
| Ammonium thiosulfate (70 wt/vol %) | 3000 | ml |
| Disodium EDTA dihydrate | 0.45 | g |
| Sodium sulfite | 225 | g |
| Boric acid | 60 | g |
| 1-(N,N-diethylamino)ethyl-5-mercaptotetrazole | 15 | g |
| Tartaric acid | 48 | g |
| Glacial acetic acid | 675 | g |
| Sodium hydroxide | 225 | g |
| Sulfuric acid (36N) | 58.5 | g |
| Aluminum sulfate | 150 | g |
| | pH 4.68 | |

Preparation of processing solutions

A container assembly included three independent containers which were filled with developer concentrate parts A, B and C, respectively. Another container was filled with the fixer concentrate.

The developing tank was charged with 20 ml per liter of the developer of an aqueous solution containing 3.7 grams of potassium bromide and 3.6 grams of acetic acid as the starter. The container assembly was turned upside down and fitted in place in a receptacle on the side of the processor so that knife edges cut into the caps of the respective containers whereby the concentrates flowed from the containers to a developer stock tank. Using a metering pump, the developer concentrate was pumped to the developing tank along with diluting water. Similarly, the fixer container was fitted in a corresponding receptacle to charge a fixer stock tank with the fixer concentrate, which was pumped to the fixing tank through a metering pump along with diluting water. The amounts of the developer and fixer concentrates pumped to the respective tanks are shown below. Every 8 sheets (10×12 inches) of photosensitive material being processed, the tanks were made up with the developer and fixer by diluting the respective concentrates with water in the same proportion.

| | | |
|---|---|---|
| Developer | | |
| Part A | | 55 ml |
| Part B | | 10 ml |
| Part C | | 10 ml |
| Water | | 125 ml |
| | pH 10.50 | |
| Fixer | | |
| Concentrate | | 80 ml |
| Water | | 120 ml |
| | pH 4.62 | |

The washing tank was filled with city water. Water was made up at a rate of 3 liter/min. only during processing of photosensitive material. For preventing generation of bio-slime in the washing tank, an aqueous solution 60 grams of ethylenediaminetetraacetic acid dihydrate and 20 grams of glutaraldehyde in 1 liter of water was added to the washing tank in an amount of about 5 ml/hour independent of whether the processor was operating or in standby state. This amount of the solution was added in four divided portions per hour by actuating a pulse pump for one minute on every 15 minutes.

Processor arrangement

A processor having a series of developing, fixing, washing and drying sections was used. Table 1 shows the parameters of the respective sections.

TABLE 1

| | Tank volume | Process temp. | Path length | Processing time |
|---|---|---|---|---|
| Development | 15 l | 35° C. | 621 mm | 13.3 sec. |
| (liquid surface area/tank volume = 35 $cm^2$/liter) | | | | |
| Fixation | 15 l | 32° C. | 546 mm | 11.7 sec. |
| Washing | 13 l | 17° C. (flowing) | 266 mm | 5.7 sec. |
| Squeezing | | | 308 mm | 6.6 sec. |
| Drying | | 58° C. | 373 mm | 8.0 sec. |
| Total | | | 2114 mm | 45.3 sec. |

Process

Sheets (10×12 inches) of the photosensitive material which had been exposed to X-rays were processed through the processor by using the processing solutions prepared in the above-mentioned mixing and diluting proportions, passing them through the respective sections in accordance with the schedule of Table 1 while replenishing 25 ml of the developer and 25 ml of the fixer per sheet.

The drying section was of the structure shown in FIGS. 1 and 2 and had the following specifications.

Revolution of drive shaft: 350 rpm
Conveyor roller diameter: 20 mm
Conveyor roller material: phenolic resin (extrusion molded)
Sheet feed per revolution of drive shaft (M): 8 mm
Gear on drive shaft: 16 teeth
Sheet feed on gear rotation by one tooth (N): 4 mm
Hot air temperature: 50°-70° C.
Hot air flow rate: 9-11 $m^3$/min.
Slit nozzle orifice width: 2.5 mm
Injection speed of hot air from nozzle: 12-15 m/sec.
Injection angle of hot air from nozzle ($\alpha$): ~5°
Nozzle-to-sheet spacing: 3 mm (min) to 7 mm (max) (see FIG. 4)
Roller-sheet contact distance (X): ~2 mm ($\theta$=~10°)

In an environment at 25° C. and RH 70%, 30 sheets of film (14×14 inches) were continuously processed at a development rate of 35% and 3 sheets of film exposed to an incandescent lamp were subsequently processed. The surface of the last three sheets was observed for evaluating the unevenness of reflection density. The unevenness was rated A to E in accordance with the following criteria.

A: fully even
B: substantially even
C: uneven at some locations, but within a practically acceptable range
D: periodic unevenness
E: noticeable periodic unevenness Proper adjustments were made on the diameter of bevel gears for transmitting the driving force from the drive shaft to the respective rollers, the number of teeth on the gear on the drive shaft, and the number of revolutions of the drive motor in the drying section. The results are shown in Table 2.

TABLE 2

| Run No. | Distance L or P between rollers or nozzles | Number of rollers or nozzles | k1 | k2 | k3 | Unevenness |
|---|---|---|---|---|---|---|
| 1 | 14 mm | 18 | 1 | 1 | 3 | A |
| 2 | 14.5 mm | 18 | 1 | 1 | 3 | A |
| 3 | 15 mm | 17 | 1 | 1 | 3 | B |
| 4C | 15.5 mm | 17 | — | — | 3 | D |
| 5C | 16 mm | 16 | — | — | — | E |
| 6C | 16.5 mm | 16 | — | — | 4 | D |
| 7 | 17 mm | 16 | 2 | 2 | 4 | B |
| 8 | 17.5 mm | 16 | 2 | 2 | 4 | A |
| 9 | 18 mm | 16 | 2 | 2 | 4 | A |
| 10* | 18.5 mm | 16 | 2 | 2 | 4 | A |
| 11* | 19 mm | 16 | 2 | 2 | 4 | B |
| 12* | 19.5 mm | 16 | 2 | 2 | 4 | C |
| 13* | 20 mm | 16 | 2 | 2 | — | C |
| 14* | 20.5 mm | 16 | 2 | 2 | 5 | C |
| 15* | 21 mm | 16 | 2 | 2 | 5 | B |
| 16* | 22 mm | 16 | 2 | 2 | 5 | A |

Run Nos. 4C, 5C and 6C are outside the scope of the invention.

Run Nos. 10-16 had a longer path in the drying section so that the drying time was longer than in Table 1.

The roller-to-roller distance L (mm) and the nozzle-to-nozzle distance P (mm) were determined in accordance with relationships (1), (2) and (3) by setting $k_1$, $k_2$ and $k_3$ at the values shown in Table 2. This also applies to the following examples.

As is evident from Table 2, drying marks occurred within the practically acceptable range in the samples processed in accordance with the invention.

EXAMPLE 2

The procedure of Example 1 was repeated for evaluating drying marks except that the drying section was modified to the following specifications. The results are shown in Table 3.

Modified parameters in the drying section
Revolution of drive shaft: 224 rpm
Sheet feed per revolution of drive shaft (M): 12.5 mm
Gear on drive shaft: 30 teeth
Sheet feed on gear rotation by one tooth (N): 2.5 mm

TABLE 3

| Run No. | Distance L or P between rollers or nozzles | Number of rollers or nozzles | kl | k2 | Unevenness |
|---|---|---|---|---|---|
| 21 | 11 mm | 25 | 0 | 0 | A |
| 22C | 12.5 mm | 22 | — | — | E |
| 23 | 14 mm | 19 | 1 | 1 | A |
| 24 | 15 mm | 17 | 1 | 1 | B |
| 25 | 17.5 mm | 16 | 1 | 1 | B |
| 26* | 20 mm | 16 | 1 | 1 | B |
| 27* | 22.5 mm | 16 | 1 | 1 | B |
| 28*C | 25 mm | 16 | — | — | E |

Run Nos. 22C and 28C are outside the scope of the invention.

Run Nos. 26–28 had a longer path in the drying section so that the drying time was longer than in Table 1.

The effectiveness of the invention is evident from Table 3.

EXAMPLE 3

(1) Preparation of silver halide emulsion

In a container, 32 grams of gelatin was dissolved in 1 liter of water. To the container heated at 53° C. were added 5 grams of sodium chloride, 0.3 grams of potassium bromide and 46 mg of a compound of the following formula.

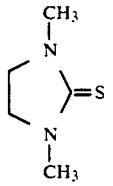

To the container 400 ml of an aqueous solution containing 80 grams of silver nitrate and 415 ml of an aqueous solution containing 40 grams of potassium bromide and 8 grams of sodium chloride were added over about 25 minutes by a double jet mixing method. Then 400 ml of an aqueous solution containing 80 grams of silver nitrate and 415 ml of an aqueous solution containing 40 grams of potassium bromide, 8 grams of sodium chloride and $10^{-7}$ mol/mol Ag of potassium hexachloroiridate (III) were added to the solution by a double jet mixing method. An emulsion of silver halide grains was prepared in this way.

After desalting, 60 grams of gelatin was added to the emulsion, which was adjusted to pH 6.5 and pAg 8.5. The emulsion was chemically sensitized by raising the temperature to 55° C., adding 3.4 mg of chloroauric acid and maintaining at the temperature for 60 minutes. Thereafter, 250 mg of 4-hydroxy-6-methyl-1,3,3a,7-tetraazaindene and 1.8 grams of a compound $C_6H_5—OCH_2CH_2OH$ were added to the emulsion which was quenched and solidified. This emulsion is designated emulsion A.

(2) Preparation of emulsion coating solution

A 850-gram portion of emulsion A was weighed and heated at 40° C. back to the emulsion form. By adding the following components thereto, an emulsion coating solution was prepared.

Emulsion coating solution

| | | |
|---|---|---|
| (a) | Emulsion A | 850 g |
| (b) | Spectral sensitizing dye (I) | $1.2 \times 10^{-4}$ mol |
| (c) | Supersensitizer (II) | $0.8 \times 10^{-3}$ mol |
| (d) | Storage improver (III) | $1 \times 10^{-3}$ mol |
| (e) | Polyacrylamide (Mw 40,000) | 7.5 g |
| (f) | Trimethylolpropane | 1.6 g |
| (g) | Sodium polystyrenesulfonate | 2.4 g |
| (h) | Poly(ethyl acrylate/methacrylic acid) latex | 16 g |
| (i) | N,N'-ethylenebis(vinylsulfonacetamide) | 1.2 g |

Spectral sensitizing dye (I):

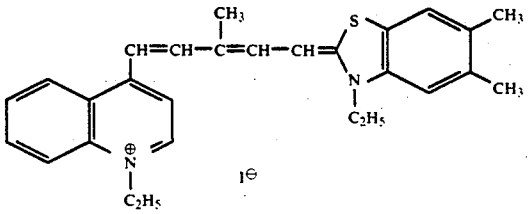

Supersensitizer (II):

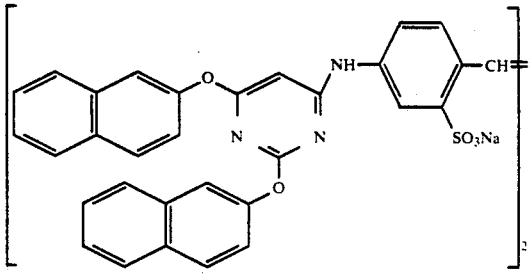

Storage improver (III):

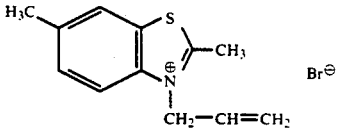

(3) Preparation of surface protective layer coating solution

A coating solution for forming a surface protective layer on the emulsion layer was formulated by mixing the following components in a container heated at 40° C.

Surface protective layer coating solution

| | | |
|---|---|---|
| (a) | Gelatin | 100 g |
| (b) | Polyacrylamide (Mw 40,000) | 10 g |
| (c) | Sodium polystyrenesulfonate (Mw 600,000) | 0.6 g |
| (d) | N,N'-ethylenebis(vinylsulfonacetamide) | 1.5 g |
| (e) | Polymethyl methacrylate fine particles (means particle size 2.5 μm) | 2.2 g |
| (f) | Sodium t-octylphenoxyethoxyethanesulfonate | 1.2 g |
| (g) | $C_{16}H_{33}O—(CH_2CH_2O)_{10}—H$ | 2.7 g |
| (h) | Sodium polyacrylate | 4 g |
| (i) | $C_8F_{17}SO_3K$ | 70 mg |
| (j) | $C_8H_{17}SO_2N(C_3H_7)(CH_2CH_2O)_4(CH_2)_4—SO_3Na$ | 70 mg |
| (k) | NaOH (1 N) | 4 ml |
| (l) | Methanol | 60 ml |

-continued

| | | |
|---|---|---|
| (m) | Compound (IV) | 60 mg |

Compound (IV):

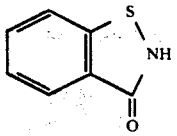

(4) Preparation of back layer coating solution

A coating solution for forming a back layer was formulated by mixing the following components in a container heated at 40° C.

| Back surface protective layer coating composition | | |
|---|---|---|
| (a) | Gelatin | 80 g |
| (b) | Sodium polystyrenesulfonate | 0.3 g |
| (c) | N,N'-ethylene-bis(vinylsulfonacetamide) | 1.7 g |
| (d) | Polymethyl methacrylate fine particles (mean particle size 3.5 μm) | 4 g |
| (e) | Sodium t-octylphenoxyethoxyethanesulfonate | 3.6 g |
| (f) | NaOH (1N) | 6 ml |
| (g) | Sodium polyacrylate | 2 g |
| (h) | $C_{16}H_{33}O—(CH_2CH_2O)_{10}—H$ | 3.6 g |
| (i) | $C_8F_{17}SO_3K$ | 50 mg |
| (j) | $C_8F_{17}SO_2N(C_3H_7)(CH_2CH_2O)_4(CH_2)_4—SO_3Na$ | 50 mg |
| (k) | Methanol | 130 ml |
| (l) | Compound (IV) | 60 mg |

| Back layer coating composition | | |
|---|---|---|
| (a) | Gelatin | 100 g |
| (b) | Dye (V) | 3.1 g |
| (c) | Sodium polystyrenesulfonate | 0.6 g |
| (d) | Poly(ethyl acrylate/methacrylic acid) latex | 15 g |
| (e) | N,N'-ethylene-bis(vinylsulfonacetamide) | 4.3 g |
| (f) | Oil dispersion of Dye (VI) as described in JP-A 285445/1986 | 250 mg* |
| (g) | Surfactant dispersion of Dye (VII) as described in JP-A 285445/1986 | 50 mg* |
| (h) | Compound (IV) | 60 mg |

*calculated as dye itself

Dye (V):

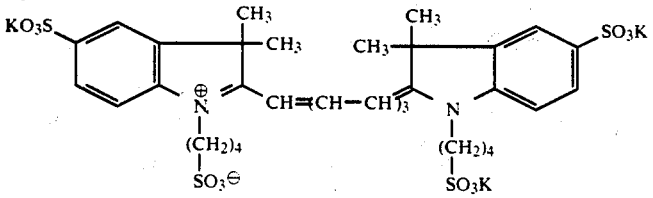

Dye (VI):

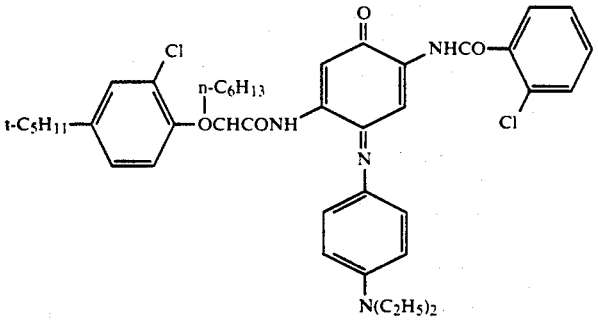

Dye (VII):

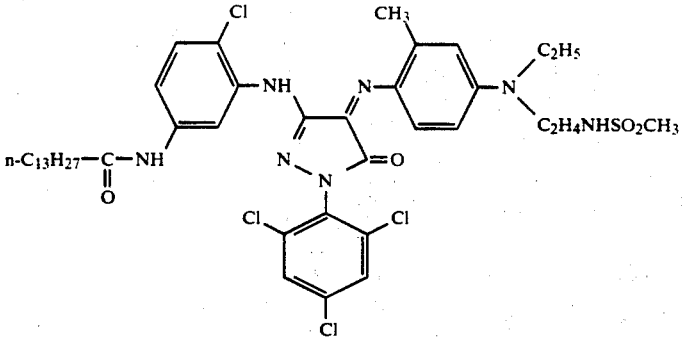

(5) Preparation of surface protective layer coating solution on back layer

A coating solution for forming a surface protective layer on the back layer was formulated by mixing the following components in a container heated at 40° C.

(6) Preparation of photosensitive material

A blue-tinted PET support on one surface was coated with the back layer coating solution and the back layer surface protective layer coating solution to form a back layer with a gelatin coverage of 2 g/m² and a surface protective layer with a gelatin coverage of 1 g/m² thereon. The support on the opposite surface was coated with the emulsion layer coating solution and the emulsion layer surface protective layer coating solution to provide a silver coverage of 2.2 g/m$^2$ and a surface protective layer gelatin coverage of 1 g/m$^2$.

In the coated sample, the coating on the back side had a swelling factor of 150% and the coating on the emulsion side had a swelling factor of 160%.

(7) Processing

The coated sample was allowed to stand for 7 days at 25° C. and RH 60%, subjected to scanning exposure using a semiconductor laser of 780 nm (FCR700 Laser Image Printer type CR-LP414, manufactured by Fuji Photo-Film Co., Ltd.) at room temperature, and then processed with the following developer and fixer while replenishing their replenishers.

| Developer concentrate | |
|---|---|
| Potassium hydroxide | 24 g |
| Sodium sulfite | 40 g |
| Potassium sulfite | 50 g |
| Diethylenetriaminepentaacetic acid | 2.4 g |
| Boric acid | 10 g |
| Hydroquinone | 35 g |
| Diethylene glycol | 11 g |
| 4-hydroxymethyl-4-methyl-1-phenyl-3-pyrazolidone | 6 mg |
| 5-methylbenzotriazole | 60 g |
| Compound (VIII) | 0.3 g |
| Compound (IX) | 0.2 g |
| Compound (X) | 0.12 g |
| Water | totaling to 400 ml |
| | pH 11.00 |

Compound (VIII):

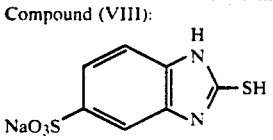

Compound (IX):

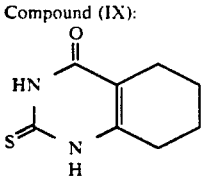

Compound (X):

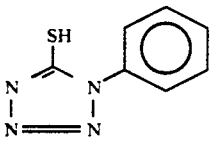

| Fixer concentrate | |
|---|---|
| Ammonium thiosulfate | 140 g |
| Sodium sulfite | 15 g |
| Disodium EDTA dihydrate | 25 mg |
| Sodium hydroxide | 6 g |
| Water | totaling to 250 ml |
| | pH 5.10 |

At the start of processing, the tanks were filled with the following solutions.

Developing tank: a developer at pH 10.50 prepared by mixing 400 ml of the developer concentrate, 600 ml of water and 10 ml of an aqueous solution containing 2 grams of potassium bromide and 1.8 grams of acetic acid.

Fixing tank: a fixer at pH 4.45 prepared by mixing 250 ml of the fixer concentrate and 750 ml of water.

Washing tank: city water

On every 8 sheets (25.7×36.4 cm) of the coated sample or photosensitive material, the developing tank was made up with a mixture of 80 ml of the developer concentrate and 120 ml of water (adjusted at pH 10.7) and the fixing tank was made up with a mixture of 50 ml of the fixer concentrate and 150 ml of water. The washing tank was made up with 5 liter/min. of water during processing. For preventing generation of bio-slime in the washing tank, an aqueous solution containing 60 grams of disodium ethylenediaminetetraacetate dihydrate and 20 grams of glutaraldehyde in 1 liter of water was added to the washing tank in an amount of about 6 ml/hour insofar as the tank was full of water. This amount of the solution was added in four divided portions per hour.

Processor arrangement

A processor having a series of developing, fixing, washing and drying sections was used. Table 4 shows the parameters of the respective sections.

TABLE 4

| | Tank volume | Process temp. | Path length | Processing time |
|---|---|---|---|---|
| Development | 7.5 l | 35° C. (inclusive of rinse) | 347 mm | 6.6 sec. |
| Fixation | 7.5 l | 35° C. (inclusive of rinse) | 294 mm | 5.6 sec. |
| Washing | 6.0 l | 17° C. | 186 mm | 3.6 sec. |
| Squeezing | | | 183 mm | 3.5 sec. |
| Drying | | 60° C. | 301 mm | 5.8 sec. |
| Total | | | | 25.1 sec. |
| | (linear speed 50.8 mm/sec.) | | | |

The drying section was of the structure shown in FIGS. 1 and 2 and had the following specifications with only changes from Example 1 being shown.

Revolution of drive shaft: 233 rpm
Sheet feed per revolution of drive shaft (M): 13.1 mm
Number of conveyor rollers: 16
Number of slit nozzles: 16
Roller-to-roller distance L=nozzle-to-nozzle distance P: 34 mm
Hot air temperature: 60° C.
Hot air flow rate: 11 m$^3$/min.
Gear on drive shaft: 32 teeth
Sheet feed on gear rotation by one tooth (N): 1.96 mm The thus processed sheets were evaluated for drying marks as in Example 1, finding no drying marks.

EXAMPLE 4

Run No. 1 of Example 1 and Example 3 were repeated by incorporating a far-infrared heater pre-drying stage in front of the drying section as shown in FIG. 7. With respect to drying marks, equivalent excellent results were obtained. Even when the drying time was reduced by about 20% from examples 1 and 3, no uneven drying occurred.

EXAMPLE 5

Run No. 1 of Example 1 and Example 3 were repeated by incorporating heat rollers in the drying section as shown in FIG. 8. The heat rollers had a surface temperature of about 100° C. With respect to drying marks, equivalent excellent results were obtained. Even when the drying time was reduced by about 50% from Examples 1 and 3, no uneven drying occurred.

According to the present invention, drying with an increased drying capacity can be applied to the processing of photosensitive material with reduced film hardening effect whereby drying is accomplished without leaving drying marks. The invention facilitates solution preparation, improves the working environment and allows for rapid processing.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for processing a photographic silver halide photosensitive material after exposure through an automatic processor comprising a developing section for developing the material with an alkaline developer, a fixing section for fixing the material with a fixer at pH 4.6 or higher, a washing section for washing the material with water and/or a stabilizing section for stabilizing the material, and a drying section for drying the material, said processor drying section includes a plurality of conveyor rollers for defining a path, a drive shaft operatively coupled to the rollers to rotate the rollers for feeding the photosensitive material forward along the path, and a plurality of air injectors for injecting hot air against the surfaces of the photosensitive material traveling along the path, the plurality of conveyor rollers and/or the plurality of air injectors are arranged in said drying section so as to satisfy at least one of the relationships represented by the following formulae (1) and (2):

$$k_1M+0.5<L<(k_1+1)M-0.5 \quad (1)$$

$$k_2M+0.5<P<(k_2+1)M-0.5 \quad (2)$$

wherein L is the distance (in mm) between two adjacent conveyor rollers,

P is the distance (in mm) between two adjacent air injectors,

M is the distance (in mm) over which the photosensitive material is fed per revolution of the drive shaft, $k_1$ is equal to 0 or an integer of 1 to 8, and $k_2$ is equal to 0 or an integer of 1 to 8.

2. The processing method of claim 1 wherein said drying section further includes a gear having a plurality of teeth coupled between the drive shaft and the conveyor rollers, the plurality of conveyor rollers are arranged in said drying section so as to satisfy the relationship represented by the following formula (3):

$$k_3N+0.5<L<(k_3+1)N-0.5 \quad (3)$$

wherein L is as defined above,

N is the distance (in mm) over which the photosensitive material is moved per movement of the gear by one tooth, and $k_3$ is an integer of 1 to 20.

3. The processing method of claim 1 wherein said air injectors inject hot air against the photosensitive material surface in a direction opposite to the feed direction of the photosensitive material.

4. The processing method of claim 1 wherein each said air injector includes a nozzle orifice which is spaced a distance of 1 to 15 mm apart from the path.

5. The processing method of claim 1 wherein said drying section further includes a far-infrared heater.

6. The processing method of claim 1 wherein at least one of the conveyor rollers in said drying section is a heat roller.

7. The processing method of claim 1 wherein the overall processing time is about 20 seconds to about 90 seconds.

8. The processing method of claim 1 wherein said fixer is a one-part type fixer solution available in concentrate or working solution form.

9. The processing method of claim 8 wherein said fixer contains an aluminum salt and said photosensitive material has a swelling factor of up to 250%.

10. The processing method of claim 8 wherein said fixer is free of an aluminum salt and said photosensitive material has a swelling factor of up to 200%.

11. The processing method of claim 8 wherein said fixer is replenished at a rate of 0.05 to 0.6 liters per square meter of the photosensitive material.

* * * * *